US007912237B2

(12) United States Patent
Fischer

(10) Patent No.: US 7,912,237 B2
(45) Date of Patent: Mar. 22, 2011

(54) MICROPHONE DEVICE WITH AN ORIENTATION SENSOR AND CORRESPONDING METHOD FOR OPERATING THE MICROPHONE DEVICE

(75) Inventor: Eghart Fischer, Schwabach (DE)

(73) Assignee: Siemens Audiologische Technik GmbH, Erlangen (DE)

( * ) Notice: Subject to any disclaimer, the term of this patent is extended or adjusted under 35 U.S.C. 154(b) by 1090 days.

(21) Appl. No.: 11/402,328

(22) Filed: Apr. 11, 2006

(65) Prior Publication Data

US 2006/0233406 A1 Oct. 19, 2006

(30) Foreign Application Priority Data

Apr. 15, 2005 (DE) ..... 10 2005 017 496

(51) Int. Cl.
*H04R 25/00* (2006.01)

(52) U.S. Cl. ..... 381/315; 381/313

(58) Field of Classification Search ..... 381/313, 381/92, 315

See application file for complete search history.

(56) References Cited

U.S. PATENT DOCUMENTS

| | | | | |
|---|---|---|---|---|
| 5,905,464 | A | 5/1999 | Lanciaux | |
| 7,450,731 | B2 * | 11/2008 | Barthel | 381/313 |
| 7,542,580 | B2 * | 6/2009 | Burns | 381/313 |
| 2003/0103091 | A1 | 6/2003 | Wong et al. | |
| 2005/0069149 | A1 | 3/2005 | Takahashi et al. | |
| 2007/0064959 | A1 * | 3/2007 | Boothroyd | 381/92 |

FOREIGN PATENT DOCUMENTS

| | | | |
|---|---|---|---|
| DE | 40 34 096 | A1 | 1/1992 |
| DE | 696 05 773 | T2 | 12/1997 |
| EP | 1519625 | A2 | 3/2005 |
| WO | 0149070 | A1 | 7/2001 |
| WO | WO 2004/093487 | A2 | 10/2004 |

* cited by examiner

*Primary Examiner* — Suhan Ni
*Assistant Examiner* — Jasmine Pritchard

(57) ABSTRACT

A directional microphone for a hearing device should be easy for the user to operate. To this end it is equipped with an orientation sensor, such that it can be controlled as a function of orientation. It is for example possible in this manner to switch it to directional operation, when it is aligned horizontally. When it is aligned vertically, the directional microphone is for example switched automatically to omni-directional operation.

12 Claims, 1 Drawing Sheet

MICROPHONE DEVICE WITH AN ORIENTATION SENSOR AND CORRESPONDING METHOD FOR OPERATING THE MICROPHONE DEVICE

CROSS REFERENCE TO RELATED APPLICATIONS

This application claims priority to the German Application No. 10 2005 017 496.5, filed Apr. 15, 2005 which is incorporated by reference herein in its entirety.

FIELD OF INVENTION

The present invention relates to a microphone device for a hearing device with at least two microphones, which are disposed in a straight line, to achieve a directional effect and a control device for controlling the microphones. The present invention also relates to a corresponding method for operating such a microphone device.

BACKGROUND OF INVENTION

External directional microphones for hearing devices are known. These external directional microphones transmit signals with an improved signal to noise ratio wirelessly to the corresponding hearing devices. They generally have an on/off switch and a switch for adjusting the nature or strength of the directional effect. A hearing device with an external directional microphone is for example known from WO 2004/093487 A2.

A circuit arrangement for switching mobile devices, for example hearing aids, on and/or off automatically is known from DE 40 34 096 A1. This known arrangement has a movement detector that detects a change in orientation or inclination. This known orientation sensor supplies an alternating signal to a circuit. The alternating signal indicates that the hearing aid is moving, as a result of which its orientation is changing. The circuit only switches the power supply on when an alternating signal from the orientation sensor is present. The power supply is switched off again, when no alternating signal from the orientation sensor is present for a specific time period.

A personal location device is known from DE 696 05 773 T2, with which an angle is generally measured between the direction from which a source emits electromagnetic, infrared or ultrasonic radiation and the direction in which a person has oriented their head.

SUMMARY OF INVENTION

Use of such external directional microphones requires the user to adjust the currently required nature or strength of the directional effect by activating a switch. As this sometimes has to be done in very fast-changing hearing situations, the user is soon overwhelmed or irritated by the constant need to activate the switch. A typical situation, in which the user constantly has to switch between directional and omni-directional operation of the microphone, is for example a discussion, which alternates between a number of people speaking simultaneously and individual people speaking alone.

An object of the present invention is therefore to propose a microphone device, which is easier to operate. A corresponding method for operating such a microphone device will also be specified.

According to the invention this object is achieved by a microphone device for a hearing device with at least two microphones, which are disposed in a straight line, to achieve a directional effect and a control device for controlling the microphones, with the control device having an orientation sensor, which is connected permanently to the microphone in a mechanical manner and which emits an orientation signal as a function of the orientation of the straight line of microphones, such that control of the microphones can be influenced by the orientation signal.

According to the invention a method is also provided for operating a microphone device for hearing devices by aligning the microphone device such that it assumes a selected orientation and controlling the microphone device according to the selected orientation.

Operation of the claimed microphone therefore advantageously requires no switch activation in changing hearing situations. Automation detection of the orientation of the microphone device means instead that the user can utilize the intuitive alignment of the microphone device for switching and control processes.

As a directional microphone, the microphone device has a main pick-up direction. According to a preferred embodiment therefore the control device will switch off the microphones, when the main pick-up direction is oriented essentially vertically downward. This utilizes the fact that sound generally does not come from below.

The control device can also switch the microphones to directional operation, when the main pick-up direction is oriented in an essentially horizontal manner. This takes into account the fact that the majority of sound sources are typically in a horizontal plane around the user.

According to a further embodiment of the claimed microphone device, the control device can switch the microphones to omni-directional operation, when the main pick-up direction is oriented essentially vertically upward. It is thereby possible to benefit from the arrangement of the microphones vertically on top of each other for omni-directional operation.

The claimed microphone device is preferably implemented as an external component in respect of the hearing device. It can for example be configured in the form of a pen that operates very unobtrusively and can be oriented in any direction.

It is favorable for the microphone device to have a transmission interface for the wireless transmission of microphone signals to the hearing device. This means that the hearing device wearer is completely independent of the hearing device when orienting the microphone device.

BRIEF DESCRIPTION OF THE DRAWING

The present invention is described in more detail below with reference to the accompanying drawings, in which.

DETAILED DESCRIPTION OF INVENTION

The exemplary embodiment described in more detail below represents a preferred embodiment of the present invention.

Figure 1:
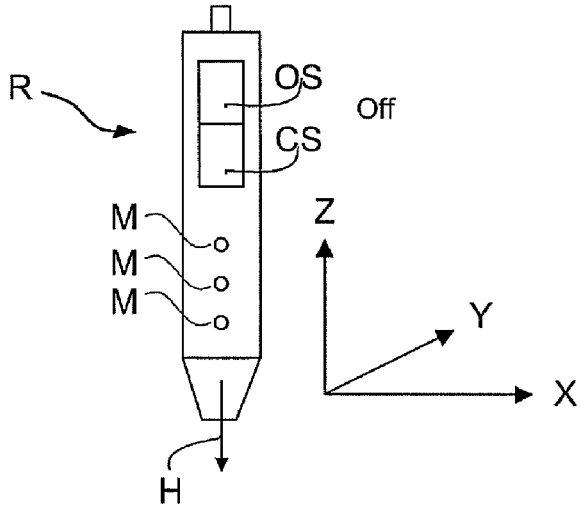
FIG. 1 shows a diagram of a claimed microphone device in an off position.

A claimed external microphone for a hearing device is configured in the form of a pen according to the example in FIG. 1. The directional microphone R here has three microphones M, disposed along the longitudinal axis of the pen. This also predefines the main pick-up direction H of the directional microphone R. The number of microphones can also be two, four, five or more. Microphones can also be disposed on another side of the pen-type directional microphone R. The directional microphone R also has a control switch CS to control the microphones, with the control switch containing an orientation sensor OS.

In the diagram in FIG. 1 the pen-type directional microphone R is shown with its tip pointing downward. This means that the main pick-up direction H points in a negative z direction. The corresponding Cartesian coordinates system is shown in FIG. 1. The horizontal plane is shown by the coordinates X and Y.

The control switch of the directional microphone R is set up such that it switches off the directional microphone R in the position shown in FIG. 1 with the main pick-up direction or tip pointing downward in response to the orientation sensor. If the tip or directional microphone R is therefore held vertically downward or is for example carried thus in the breast pocket, this means that the directional microphone R is not to be used and it should therefore be switched off automatically.

Figure 2:
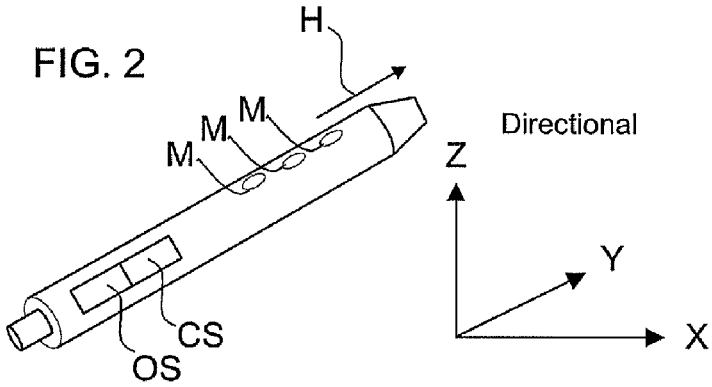
FIG. 2 shows a diagram of a claimed microphone device in an directional operation position.

According to FIG. 2 the directional microphone R is oriented horizontally in an X-Y plane. The main pick-up direction H is pointed in a required direction. The orientation sensor has automatically identified the horizontal orientation of the directional microphone R and therefore switches the directional microphone R to directional operation. In this position the pen or directional microphone is for example directed toward a conversation partner and a directional effect is required according to the orientation of the pen. The pen can thereby be held unobtrusively in the hand or correspondingly oriented on the table.

Figure 3:
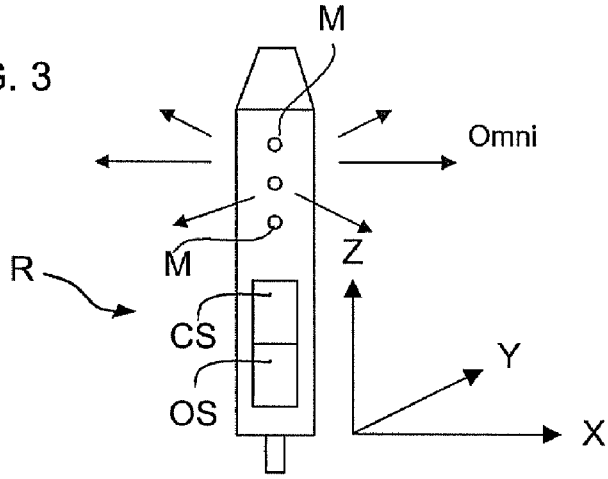
FIG. 3 shows a diagram of a claimed microphone device in an omni-directional operation position.

If the pen or directional microphone R is however held or carried in the breast pocket according to FIG. 3 with its tip held vertically upward in a positive z direction, this means that a directional effect is not required and signals should be received equally from all directions. The orientation sensor registers this alignment of the directional microphone R, such that the control unit switches the microphones M to omni-directional operation.

In contrast to the exemplary embodiment shown, the directional microphone can also be switched to any other mode as a function of its orientation. It is for example possible therefore for the directional microphone to be switched to omni-directional operation in any vertical position (positive and negative z direction) and to directional operation when aligned horizontally. The automatic orientation switch can then be combined with a manual switch for switching the directional microphone on and off.

The strength of the directional effect can be modified continuously or quasi-continuously as a function of the inclination of the directional microphone in relation to a horizontal plane according to a further exemplary embodiment. The orientation sensor is then not only used to switch between two different operating modes but the functionality of the directional microphone also changes continuously with its orientation in space.

The invention claimed is:

1. A microphone device for a hearing aid, comprising:

at least two microphones arranged on a single structure in a straight line for enabling a directional effect of the microphone device; and a control device permanently connected to the single structure, wherein the control device selects an operation mode of the microphones, wherein the operation mode comprises an omni-directional operation mode and a directional operation mode, the control device comprising an orientation sensor functionally and mechanically connected to the microphones, the orientation sensor configured to:

detect an orientation of a current absolute main pick-up direction; and generate an orientation signal based on the detected orientation, wherein the control device selects the operation mode of the microphones at least partially based on the orientation signal.

2. The microphone device according to claim 1, wherein the control device is configured to switch off the microphones if the orientation signal indicates that a current absolute main pick-up direction has an essentially vertically downward orientation.

3. The microphone device according to claim 2, wherein the control device is further configured to switch the microphones into the directional operation mode having the directional effect if the orientation signal indicates that a current absolute main pick-up direction has an essentially horizontal orientation.

4. The microphone device according to claim 2, wherein the control device is further configured to switch the microphones into the omni-directional operation mode having the directional effect if the orientation signal indicates that a current absolute main pick-up direction has an essentially vertically upward orientation.

5. The microphone device according to claim 1, wherein the microphone device is an external component relative to the hearing aid.

6. The microphone device according to claim 5, further comprising a wireless transmission interface for wirelessly transmitting microphone signals to the hearing aid.

7. A method of operating a microphone device for a hearing aid, comprising:

assigning a directional mode of operation to a first orientation and an omni-directional mode of operation to a second orientation;

aligning a main pick-up direction of a line of microphones arranged on the microphone device according with a selected orientation;

determining the main pick-up direction using an orientation sensor fixed to the microphone device;

determining which orientation the main pick-up direction essentially matches;

selecting an operation mode of the microphone device using a control device fixed to the microphone device based on the mode of operation assigned to the matched orientation.

8. The method according to claim 7, further comprising switching off the microphone device if the main pick-up direction has an essentially vertically downward orientation.

9. The method according to claim 8, further comprising switching the microphone device into a directional operation mode having the directional effect if the main pick-up direction has an essentially horizontal orientation.

10. The method according to claim 8, further comprising switching the microphone device into an omni-directional operation mode having the omni-directional effect if the main pick-up direction has an essentially vertically upward orientation.

11. The microphone device according to claim 3, wherein the control device is further configured to vary a directional effect as a function of an inclination of the current absolute main pick-up direction in relation to the horizontal orientation when in the directional operation mode.

12. The method according to claim 9, comprising varying the directional effect as a function of an inclination of the main pick-up direction in relation to the horizontal orientation when in the directional operation mode.

* * * * *